US005865385A

United States Patent [19]

Arnett et al.

[11] Patent Number: 5,865,385

[45] Date of Patent: Feb. 2, 1999

[54] COMMINUTING MEDIA COMPRISING MARTENSITIC/AUSTENITIC STEEL CONTAINING RETAINED WORK-TRANSFORMABLE AUSTENITE

[76] Inventors: Charles R. Arnett, 6205 NW. 78th St., Kansas City, Mo. 64151; Peter J. Moroz, Jr., 728 NE. Lyon Dr., Lee's Summit, Mo. 64068; James J. Lorenzetti, 12008 Fairway Rd., Leawood, Kans. 66209

[21] Appl. No.: 804,253

[22] Filed: Feb. 21, 1997

[51] Int. Cl.[6] ..... B02C 17/20

[52] U.S. Cl. ..... 241/182; 241/184; 241/299

[58] Field of Search ..... 241/184, 182, 241/183, 291, 299; 148/609, 322, 617, 611, 905, 902; 492/58

[56] References Cited

U.S. PATENT DOCUMENTS

| | | | |
|---|---|---|---|
| 2,449,023 | 9/1948 | Thornton . | |
| 2,863,790 | 12/1958 | Chen . | |
| 3,649,370 | 3/1972 | Dorn et al. . | |
| 3,663,215 | 5/1972 | Tanczyn . | |
| 3,696,486 | 10/1972 | Benjamin . | |
| 3,860,457 | 1/1975 | Vourinen et al. . | |
| 3,895,972 | 7/1975 | Woodilla et al. . | |
| 3,912,503 | 10/1975 | Schumacher et al. . | |
| 3,961,994 | 6/1976 | Thome | 148/609 |
| 4,016,009 | 4/1977 | Economopoulos et al. . | |
| 4,016,015 | 4/1977 | Respen et al. . | |
| 4,023,988 | 5/1977 | Stickels et al. . | |
| 4,039,356 | 8/1977 | Schumacher et al. . | |
| 4,043,842 | 8/1977 | Joiret . | |
| 4,099,967 | 7/1978 | Schumacher et al. . | |
| 4,101,318 | 7/1978 | Rudy . | |
| 4,130,418 | 12/1978 | Hartvig . | |
| 4,146,412 | 3/1979 | Schumacher et al. . | |
| 4,170,499 | 10/1979 | Thomas et al. . | |
| 4,190,422 | 2/1980 | Hitzrot, Jr. . | |
| 4,191,599 | 3/1980 | Stickels et al. | 492/58 |
| 4,194,906 | 3/1980 | Krantz et al. . | |
| 4,394,168 | 7/1983 | Hartvig et al. . | |
| 4,437,902 | 3/1984 | Pickens et al. . | |
| 4,589,934 | 5/1986 | Glodowski et al. . | |
| 4,602,416 | 7/1986 | Thome | 241/184 |
| 4,715,546 | 12/1987 | Holming et al. . | |
| 4,814,140 | 3/1989 | Magee, Jr. . | |
| 4,840,686 | 6/1989 | Arnett et al. . | |
| 4,911,763 | 3/1990 | Farge et al. . | |
| 4,923,675 | 5/1990 | Svidunovich et al. . | |
| 4,929,419 | 5/1990 | Wegman et al. . | |
| 5,019,332 | 5/1991 | Wegman et al. . | |
| 5,034,069 | 7/1991 | Farge et al. . | |
| 5,273,570 | 12/1993 | Sato et al. . | |
| 5,308,408 | 5/1994 | Katila . | |
| 5,332,317 | 7/1994 | Niwa et al. . | |
| 5,344,502 | 9/1994 | Mack et al. . | |
| 5,439,535 | 8/1995 | Snagovski et al. . | |
| 5,618,355 | 4/1997 | Koyama et al. . | |

FOREIGN PATENT DOCUMENTS

| | | | |
|---|---|---|---|
| 57-89459 | 6/1982 | Japan | 492/58 |

OTHER PUBLICATIONS

Norman, T.E., Loeb, C.M. Jr., "Wear Tests on Grinding Balls" *TRANS AIME*, vol. 176, (1948), pp. 490–526.

Norman, T.E., "Climax Find New Austenitic Alloy Ideal for Ultra–Abrasive Mine–Mill Applications", *Engineering and Mining Journal*, vol. 166, No. 4 (Apr. 1965) pp. 86–90.

Moroz, Peter J. *Factors Affecting the Wear of Grinding Media During Wet Ore Grinding When the Corrosive Component of Wear is Small*, paper presented at Corrosion/85, sponsored by National Association of Corosion Engineers (Mar. 25–29, 1985).

*Primary Examiner*—Mark Rosenbaum
*Attorney, Agent, or Firm*—Shook, Hardy & Bacon

[57] ABSTRACT

Comminuting media comprising a martensitic/austenitic steel which contains at least about 40 percent by volume retained austenite, a portion of which is work transformable to martensite. The steel contains sufficient alloy content such that the steel has a martensite start and finish temperature sufficiently low to allow partial transformation of austenite to martensite during quenching of the steel from the austenitic range, but leaving some retained transformable austenite. This steel is used as a comminuting media, the retained austenite transforming to martensite through working or abrasion of the comminuting media during use in a comminution process. The outermost volume of the comminuting media which forms the wear surface and which contains the retained austenite in an amount of at least 40 percent by volume comprises at least 25 percent of the total volume of the comminuting media.

16 Claims, No Drawings

COMMINUTING MEDIA COMPRISING MARTENSITIC/AUSTENITIC STEEL CONTAINING RETAINED WORK-TRANSFORMABLE AUSTENITE

FIELD OF THE INVENTION

The present invention relates to comminuting media. More particularly, the invention is directed to comminuting members comprising a martensitic/austenitic steel containing retained, transformable austenite for improved wear characteristics.

BACKGROUND OF THE INVENTION

The cost of comminuting and processing ore in the mining industry is determined in part by the cost of the consumable wear surfaces and parts necessary to comminute the ore. To lower the operating costs associated with comminuting processes, it is desirable to increase the life of the comminuting media.

In a typical ore processing arrangement, large pieces of rock or ore must be broken into smaller pieces to liberate the valuable mineral constituents. As a representative example of one method of comminuting ore, large pieces of ore are moved into an enclosed tubular housing known as a grinding mill which rotates the ore. The tubular housing typically includes a plurality of wear resistant plates or elements attached to the interior of the housing to form a liner therein. The rotation of the mill causes the ore to impact on itself and on the liner of the mill, causing break-up of the ore.

In addition, loose comminuting elements are often added to the grinding mill to increase the rate of disintegration of the ore. These elements are steel spheres, rods, cones or the like which rotate within the mill with the ore, pounding the ore and increasing its rate of disintegration.

The comminuting elements must be extremely durable so that when they impact one another, the mill liner and the ore, they do not themselves break apart or wear at an excessive rate. It is desirable for the comminuting elements to wear very slowly in order to increase their useful life. The slower the spheres, rods or other members wear, the less often they must be replaced, thus lowering the cost of the comminuting operation.

The wear resistance of a steel is tied, at least in part, to its microstructure. It is known that martensitic steels exhibit low rates of abrasion wear, as compared to steels having another microstructure, such as pearlitic or stable austenitic steels. The microstructures of steels may be quite complex, but generally consist of one or more phases or phase mixtures, to wit, martensite, austenite, ferrite, carbide, pearlite, and bainite.

As a result of the difficulties surrounding the obtaining and identifying of particular steel microstructures, however, the hardness of a steel has generally been used as the determinant for use of the steel as a comminuting media. In particular, it has generally been taken as a "rule of thumb" that the wear resistance of a steel increases with increasing hardness. It has, therefore, been the conventional wisdom that comminuting elements should be formed from high hardness steel.

Typically, high hardness in steels is attained by increasing the carbon content and heat treating the steel, typically by using an austenitizing and quenching treatment, in such a manner as to form a high amount of martensite. Martensite is a very hard but very brittle phase. As a result, comminuting media comprising martensitic steel has the disadvantage that it may spall and chip.

As one means for increasing the spalling resistance of the martensitic steel, the steel may be given a subsequent heat treatment called tempering. Tempering of a martensitic steel reduces its brittleness, increasing its "toughness" or ability to withstand impact loading without spalling and chipping. Tempering, of course, typically reduces the hardness of the steel, and presumably its abrasion wear resistance. Tempering also adds another step to the process of making the steel, increasing the cost of the end product.

It is desirable to create a steel which is useful to form comminuting wear surfaces. The steel preferably has the wear resistance of high hardness steels such as high carbon martensitic steel, and yet is sufficiently ductile to minimize failure by cracking and spalling under impact loading.

SUMMARY OF THE INVENTION

In accordance with the present invention, comminuting media is comprised of a martensitic/austenitic steel containing unstable or work transformable retained austenite. Preferably, the steel is a martensitic/austenitic steel containing at least about 40 percent by volume of retained austenite.

In general, the carbon and alloy content of the steel of the present invention results in the steel having a martensite start temperature of between about 0 and 300 degrees Fahrenheit (−18° C. to 149° C.), and a martensite finish temperature below quenching and ambient room temperature.

In accordance with the present invention, the composition of at least a steel having the above-stated properties typically includes about 0.4 to 2.0 percent by weight carbon and an alloying element, preferably chromium and/or manganese, with the remainder iron and small amounts of other alloy elements such as nickel, silicon, molybdenum, vanadium, copper, and combinations thereof. Trace and residual impurities characteristically present in steel may likewise be present in the compositions useful in this invention.

By a conventional forging or casting process, steel is formed into the shape desired for the comminuting member. For example, a steel grinding sphere for a grinding mill may be the desired form of the comminuting media.

The microstructure of the steel forming the comminuting member is then changed by heating the steel to an austenitizing temperature at or above which substantially all of the carbides present in the steel go into solution. After heating, the steel has an austenitic structure. The steel is then quenched or cooled to below the martensite start, but not finish, temperature. Quenching transforms no more than about 60 percent by volume of the austenite into martensite, leaving a martensitic/austenitic steel with retained transformable austenite.

Since it is the wear characteristics of the comminuting media sought to be improved, it is the outermost volumetric layer of the comminuting media which is desirably formed of the martensitic/austenitic steel containing at least about 40 percent by volume of retained austenite. Accordingly, the outermost volume of the comminuting member represents at least 25 percent of the total volume of the comminuting member.

Formed and processed as described, the comminuting member, such as a grinding sphere, is then ready for use in a comminution process. The impact loading or "working" of the comminuting member during normal operation of the comminution process (such as a grinding mill) has the effect of transforming some or all of the retained austenite at the wear surface into the more durable martensite.

Advantageously, the resulting comminuting media in accordance with the present invention is extremely wear resistant, both as to abrasion and chipping and spalling. The comminuting member may have enhanced corrosion wear resistance as the result of the inclusion of sufficient levels of one or more alloys. It may be used in its as-quenched form, or it may be subjected to some tempering or other processing before use.

Further objects, features, and advantages of the present invention over the prior art will become apparent from the detailed description which follows.

DETAILED DESCRIPTION OF THE PREFERRED EMBODIMENT

Unless otherwise expressly noted herein, all percent figures are to be construed on a weight basis, all temperatures are to be based on a Fahrenheit scale, and all chemical symbols are to be referenced to the periodic chart of elements. It is noted that the percent of retained austenite is consistently expressed herein on a volume basis. The portion of the comminuting media made up of retained austenite is also expressed as a volume percent of the total volume.

The field of this invention relates generally to improved materials of construction and products for the wear surfaces of various equipment, parts and accessories utilized in material size reduction processes. Common processing terms associated with material size reduction include comminuting, grinding, crushing and pulverizing which may contemplate both wet and dry operations. Such processes may be carried out in equipment which may include, but not be limited to, jaw crushers, gyratory crushers, roll crushers, hammer mills, grinding mills, ball mills, vibratory mills, tower mills, verti-mills and the like. Accordingly, the term "comminuting" is used herein as a reference to any of the foregoing type material size reduction processes for various ores, rocks, aggregates and similar substances for which size reduction is necessary. The term comminuting "media", "member", or "element" is used herein as a reference to the generally consumable, wear surfaces of the foregoing equipment, parts and accessories which contact the ore, rock, aggregate or similar substance in carrying out a size reduction process More specifically, the present invention relates to comminuting media comprising a tough alloy steel. The steel is a martensitic/austenitic steel containing a large amount of unstable retained austenite. Preferably, the steel comprises at least approximately 40 percent by volume, with as much as 50 to 100 percent by volume, of retained austenite, the remainder of the steel preferably having a martensitic structure. Preferably, a portion of this retained austenite is of the unstable or "work transformable" type so that a portion thereof may be transformed to martensite under mechanical loading in accordance with the teachings of our invention.

Inasmuch as it is an objective of our invention to provide comminuting media having improved wear characteristics, it should be understood that it is the outermost volumetric layer of the comminuting media which is desirably formed of martensitic/austenitic steel with a microstructure containing at least about 40 percent by volume of retained austenite. Stated differently, it is the consumable wear layer of the comminuting member which must contain the retained austenite. Accordingly, the outermost volume of the comminuting member, which contains the retained austenite of at least 40 percent by volume, represents at least 25 percent of the total volume of the comminuting member. For example, in a 6" (15 cm.) diameter grinding sphere, an inner spherical core of roughly 5.5" (14 cm.) diameter represents approximately 75 percent of the total volume such that the outer volumetric layer of a thickness slightly greater than 0.25" (0.6 cm.) represents about 25% of the total volume of the grinding sphere. It is this outer layer of at least 25 percent of the total volume of the grinding member which is to be formed of the martensitic/austenitic steel containing retained austenite of at least 40 percent by volume. Naturally, further benefits may be achieved as the percentage of the total volume of the grinding member made up of the retained austenite microstructure is increase from at least 25 percent up to 100 percent of the total volume of the grinding member. Moreover, the dimensional thickness which represents at least 25 percent of the total volume of the comminuting member will vary in accordance with the volumetric configuration of the comminuting member as determined by known mathematical relationships for calculating the volume of solids.

As detailed below, steels in accordance with the present invention meeting this criteria have a composition which generally includes about 0.4 to 2.0 percent by weight carbon and an alloying element, preferably chromium and/or manganese, with the remainder iron and small amounts of other alloy elements such as nickel, silicon, molybdenum, vanadium, copper, and combinations thereof. This steel is heated into the austenitic range until substantially all carbides are dissolved, at which point the steel is quenched or cooled, transforming some of the austenite to martensite.

This as-quenched steel has a minimum unworked hardness of at least 20 HRC (Rockwell hardness). It has been observed that when worked, the hardness (at least on the worn surface) approaches a Rockwell hardness of 50 or more. It is believed that working the above-described steel has the effect of transforming the retained austenite at the wear surface into a martensitic structure.

It has been found that the martensite start (Ms) and finish (Mf) temperature of the steel can be correlated to the desired retention of austenite in the as-quenched martensitic/austenitic steel. In particular, the Ms temperature of the steel of the present invention is preferably between about 0 and 300 degrees Fahrenheit (−18° C. to 149° C.), and most preferably between about 30 and 225 degrees Fahrenheit (−1° C. to 107° C.), and still more preferably between about 50 and 150 degrees Fahrenheit (10° C. to 66° C.). The steel further preferably has a martensite finish temperature such that complete transformation to martensite does not occur during quenching or cooling to ambient temperature. Thus, as one aspect of the present invention, a steel having the above-stated level of retained austenite in martensite normally has an Ms temperature within the above-stated range. When the steel is quenched from the austenitic range, martensite transformation begins at Ms. However, because of the low martensite finish temperature, complete martensite transformation does not occur, with some austenite remaining untransformed.

Those skilled in the art will recognize that several known computational procedures may be used to calculate martensite start temperature (Ms). As used in this invention, the Ms temperature may be preferably calculated using the Nehrenberg formula or equation as follows:

$$Ms\ (\text{in}\ ^\circ F.) = 930 - 540*(\%carbon) - 60*(\%manganese) - 40*(\%chromium) - 30*(\%nickel) - 20*(\%silicon) - 20*(\%molybdenum);\ \text{or}$$

$$Ms\ (\text{in}\ ^\circ C.) = [898 - 540*(\%carbon) - 60*(\%manganese) - 40*(\%chromium) - 30*(\%nickel) - 20*(\%silicon) - 20*(\%molybdenum)] \div 1.8$$

In accordance with this calculation, only the weight percentage of the elements which are in solution (i.e. in the martensite or austenite matrix) is utilized.

It has been found that steels with certain specific compositions meet the above-described criteria. Preferably, the steel of the present invention has a carbon (C) content of between about 0.4 to 2 percent by weight, and most preferably between about 0.8 to 1.4 percent by weight, and still more preferably about 0.95 to 1.15 percent by weight. The steel preferably contains at least one alloying element. Preferably the alloying element includes either about 0 to 8 percent by weight of chromium (Cr) and/or between about 0 and 6 percent manganese (Mn) by weight. More preferably the steel includes either between 2 and 7 percent Cr or between about 1.5 and 6 percent Mn. Most preferably, the steel includes about 3 to 6 percent Cr, about 3 to 6 percent by weight of Mn, or a combination of both Cr and Mn.

The remainder of the steel comprises iron and small amounts of other elements. It is contemplated that a steel having the desired properties may contain, in addition or substitution of those elements (i.e., Cr and Mn) listed above, 0 to 4 percent by weight copper (Cu), 0 to 1 percent by weight vanadium (V), 0 to 2 percent by weight nickel (Ni), 0 to 2 percent by weight molybdenum (Mo) and 0 to 2 percent by weight silicon.

Trace and residual impurities characteristically present in steel making may likewise be present in the compositions useful in this invention. Likewise, additives such as grain refiners to improve toughness of the steel may be included in amounts characteristically less than 0.10 percent by weight. Representative examples of suitable grain refiners include aluminum (Al), titanium (Ti), niobium (Nb) also known as columbium, and vanadium (V).

Specifically, it has been found that the addition of alloys such as chromium and manganese has the effect of lowering the Ms and Mf temperatures. Other alloys, such as molybdenum, nickel and the like have an effect on Ms and Mf. These other alloying elements have been found less desirable because they do not affect Ms and Mf as greatly (when added in the same weight amounts).

As a specific example of the present invention, it has been found that a steel comprising 1.05 percent carbon, 1.49 percent chromium, 0.26 percent molybdenum, 0.20 percent vanadium, 0.33 percent manganese, 0.25 percent silicon, 0.02 percent nickel and the remainder iron and other alloys in small amounts inherent in the steelmaking process has a retained austenitic content of about 47 percent by volume and an Ms temperature of approximately 271 degrees Fahrenheit (133° C.) when manufactured in accordance with the techniques hereinafter to be described.

As a second specific example of the present invention, it has been found that a steel comprising 0.99 percent carbon, 4.64 percent chromium, 0.87 percent molybdenum, 0.96 percent vanadium, 0.92 percent manganese, 0.31 percent silicon, 0.12 percent nickel and the remainder iron and other alloys in small amounts inherent in the steel making process has a retained austenitic content of about 80 percent by volume and an Ms temperature of approximately 125 degrees Fahrenheit (52° C.) when manufactured in accordance with the techniques hereinafter to be described.

As a third specific example of the present invention, it has been found that a steel comprising 0.97 percent carbon, 2.71 percent chromium, 0.03 percent molybdenum, 0.60 percent manganese, 0.26 percent silicon, 0.12 percent nickel and the remainder iron and other alloys in small amounts inherent in the steel making process has a retained austenitic content of about 50 percent by volume and an Ms temperature of approximately 252 degrees Fahrenheit (122° C.) when manufactured in accordance with the techniques hereinafter to be described.

As a fourth specific example of the present invention, it has been found that a steel comprising 1.03 percent carbon, 5.17 percent chromium, 0.021 percent molybdenum, 1.14 percent manganese, 0.27 percent silicon, 0.086 percent nickel and the remainder iron and other alloys in small amounts inherent in the steel making process has a retained austenitic content of about 76 percent by volume and an Ms temperature of approximately 90 degrees Fahrenheit (32° C.) when manufactured in accordance with the techniques hereinafter to be described.

As a fifth specific example of the present invention, it has been found that a steel comprising 1.02 percent carbon, 1.52 percent chromium, 0.03 percent molybdenum, 1.52 percent manganese, 0.26 percent silicon, 0.09 percent nickel and the remainder iron and other alloys in small amounts inherent in the steel making process has a retained austenitic content of about 66 percent by volume and an Ms temperature of approximately 219 degrees Fahrenheit (104° C.) when manufactured in accordance with the techniques hereinafter to be described.

Various processing techniques may be utilized with the steel compositions selected in accordance with the foregoing principles of this invention in order to achieve comminuting media having a retained austenite in excess of 40 percent by volume.

A comminuting member is first formed from a steel having a preselected composition as previously indicated. It may be formed into any desired shape. For the comminuting media of the present invention to be used in a grinding mill, for example, the steel may be formed into spheres to serve as loose comminuting members within the mill. Alternative shapes which may be used include, but are not limited to, rods, cylinders, cones, cylpebs, bullets and slugs. If attached grinding elements are needed for the mill liner, then the steel may be formed into any shape convenient for use as a liner plate. Likewise, various parts, accessories and wear surfaces which will be contacted by the ore, rock, or the like in a grinding or crushing process may be fabricated from the preselected steel composition as required.

In short, the steel meeting the specifications of this invention is preferably manufactured by any of the known forging or casting processes into a comminuting member or element. In one preferred technique, the steel is heated to its forging temperature which is also above its critical temperature at which full austenitizing is achieved (i.e., the temperature at which all carbon and alloying elements have moved into solution). This temperature is alloy grade dependent and would typically range between 1650° F. to 2050° F. (899° C. to 1121° C.). The steel is then cooled rapidly by water, oil, air quenching or the like. The quenching cools the steel to at or below the martensite start temperature, but not the martensite finish temperature.

As an alternative technique, the comminuting member formed from a preselected steel composition may simply be allowed to cool to ambient conditions and then subsequently be reheated above its austenite start temperature. Similar to the technique previously described, the steel is then cooled by water, oil, air quenching to at or below the martensite start temperature, but not the martensite finish temperature.

So formed, the microstructure of the steel in the comminuting media is altered to a martensite/austenite structure containing retained austenite. The steel at this point in time has a minimum unworked hardness of at least 20 HRC.

The presence of the alloying elements in the steel, such as chromium or manganese, lowers the Mf temperature so that during quenching only a portion of the austenite transforms to martensite. Moreover, the preselected steel composition has the benefit that some of the austenite which is retained in the steel is transformable to martensite. Some portion of the austenite retained in the martensitic/austenitic structure must be transformable into martensite in order for the steel to exhibit the desired wear characteristics for a comminuting media. This form of austenite is distinguished from stable austenite which does not transform to martensite during subsequent working of the steel as now described.

The steel of the comminuting member is next worked or deformed. Preferably, this is accomplished at the same time the comminuting member is used during the normal operation of the comminution process in which the comminuting member is present. In particular, the surface of the comminuting element is continually worked by the contact of the element against ore or against other loose or fixed comminuting elements. This working has the effect of transforming the retained austenite into martensite at the surface of the element. The resulting surface hardness of the martensitic surface structure of the element is greater than 50 HRC and may characteristically reach a hardness in excess of 60 HRC, although such measurements are difficult to make due to the thinness of the layer of martensite.

Importantly, the comminuting media is durable even when subject to high impact loading. It is believed that the high percentage by volume of retained austenite in the microstructure of the element has the effect of bonding the areas of martensite together, minimizing the formation of cracks and other defects which would otherwise cause failure of the element during loading if the comminuting media were comprised solely of martensite.

At the same time, however, the working of the comminuting media has the effect of transforming, especially at the surface where the loading is highest, the transformable retained austenite to durable, wear resistant martensite. As the martensite wears away at the surface, new martensite is continually created through the transformation from retained austenite.

Notably, the above-referenced comminuting media does not necessarily have a microstructure before impact loading which provides for the highest hardness, contrary to the "rule of thumb" that for maximum wear resistance a steel should have the highest hardness possible. For example, for a one percent (1%) carbon steel, the steel microstructure which provides for the maximum hardness is likely to provide a hardness which may be 4 to 5 HRC or higher than comminuting media with the microstructure in accordance with the present invention.

While the Ms temperature of a steel formed in accordance with the present invention is indicative of a steel having the desired level of retained austenite, such can be verified physically. In particular, x-ray diffraction techniques well known to those skilled in the art may be utilized to verify the level of retained austenite in the as-formed steel.

As used herein, the method to determine the retained austenite level in the steel is an extension of ASTM (American Society for Testing Materials) Method E975. This extension makes use of three FCC (austenite) peaks (i.e., {111}, {200} and {220}) and three BCC/BCT (ferrite/martensite) peaks (i.e., {110}, {200} and {211}) rather than the two peaks for each specified in ASTM Method E975. This modification is to minimize the effects of preferred orientation in the determination of retained austenite. Also, chromium x-radiation is utilized to enhance the resolution. Typically, a one degree divergence slit collimator is used for limiting the amount of test area radiated. Such determinations are made in a manner well-known to those skilled in the art of using x-ray analysis for quantitative phase determinations. It is understood that the measurement yields the amount of retained austenite in the matrix of the material and not necessarily the amount of retained austenite in the total material which might typically include carbides and other nonmetallics.

Those skilled in the art of x-ray analysis will appreciate the importance of further defining the sample site for the determination of retained austenite in the comminuting member to be tested. For the purposes of this invention, the sample site will naturally be selected near the surface of the comminuting member. When testing 6" (15 cm.) diameter grinding spheres, for example, we would consistently use a sample site beginning approximately 0.25" (0.6 cm.) beneath the outer surface of the sphere as manufactured and a one degree divergence slit collimator setting for the x-ray diffraction equipment. This procedure results in a sample site selection wherein the outermost layer of the grinding member represents roughly 25 percent of the total volume of the member. Other sample site locations may be selected in accordance with accepted standards of x-ray analysis and laboratory technique as may be required by the configuration of the comminuting member to be analyzed, or as may be suggested by the condition of wear if a used comminuting member is under consideration.

As stated above, it has been determined that the Ms temperature is an indicator of the retained austenite in the steel's microstructure. As can be understood, calculating Ms from the Nehrenberg equation is often difficult because the weight percentages of each element in solution must somehow be known.

In the prior art, when a steel is prepared to maximize hardness, there are carbides and alloying elements present in the structure. With these elements out of solution, Ms must be calculated from the Nehrenberg equation with either estimated "in solution" weight values or bulk weight values, both of which tend to provide rather inaccurate results.

In accordance with the present invention, as stated above, the steel is heated to a sufficiently high temperature and for a sufficiently long time to dissolve the carbides and alloying elements so that use of the Nehrenberg relationship is effective in estimating Ms. At such elevated temperature, the weight values of the elements are their bulk values within the steel.

As can be further understood, when the comminuting media is manufactured so as to provide the optimum structure as including retained transformable austenite as disclosed above, the Nehrenberg equation may be utilized to aid in customizing the steel. The proper Ms temperature may be, as set forth above, chosen by varying the weight amounts of various elements. Thus, the weight amounts of the elements may be chosen to provide the optimum structure as set forth herein, but at the same time, those elements which are most cost effective may be added in greater amounts to create a steel with the desired Ms. Also, in those instances where the inclusion of one element may be detrimental for reasons other than its effect on Ms, the amount of another element or elements may suitably be increased in the alternative to provide the desired Ms. For example, while carbon is relatively cheap and has a strong effect on Ms, inclusion of greater than about 1.2 percent by weight often has detrimental side effects. By simply increasing the amounts of one or more other elements such as chromium or manganese, however, the desired Ms and thus the desired microstructure in accordance with the present invention may still be obtained.

In accordance with the present invention, it is believed that at least one entirely new class of products has been invented when considering the composition and processing of the steel. One well known low hardness, high alloy steel, known as Hadfield steel, utilizes typically over 6 percent Mn in order to stabilize the austenite and maintain a stable austenitic structure. On the other hand, Mn is utilized in amounts of less than 1.5 percent in other steels in order to form compounds with sulfur in the steel so that the sulfur will not form low melting iron sulfides. In accordance with the present invention, however, it is proposed to utilize between about 1.5 percent and 6 percent Mn with proper amounts of other elements to provide a steel within the desired Ms temperature range and thus the desired retained transformable austenite in accordance with the present invention.

So that our invention could be more readily understood, the detailed description to this point has been intentionally limited to microstructures having only two phases (i.e., martensite and retained austenite). However, the foregoing principles are equally adapted to the matrix present in nonhomogeneous microstructure systems.

One such possibility is the matrix resulting from intercritical heat treatment. By the term matrix of a steel, we refer to that portion of the structure which is not carbides, nitrides, sulfides, oxides or other desired or attendant phases that may occur in steels either intentionally or because they cannot be avoided in the steelmaking process. The matrix then is that portion of the steel which contains or supports all other constituents.

Consistent with the goal achieved in the two phase microstructure, the invention provides a matrix for nonhomogeneous microstructure systems wherein the matrix substantially comprises martensite and retained austenite. It is the composition of this matrix, and not necessarily the bulk or total composition of the alloy, which is the key to obtaining the proper Ms and proper amount of retained austenite.

Intercritical heat treatment austenitizes a steel alloy in a two phase austenite and carbide region rather than in a single phase austenite region of the phase diagram. In this case, at equilibrium, the composition of the matrix would be determined from that portion of a tie line which intercepts the Acm (upper critical temperature line on the hypereutectoid side) and would have the same composition as an alloy with that same composition heated into the single phase austenite region.

In any event, and regardless of whether intercritical heat treatment is employed or not, it is important and therefore a key feature of this invention that the matrix itself comprises at least approximately 40 percent by volume of retained austenite.

Another example of a nonhomogeneous microstructure system for which our invention may be adapted is a matrix resulting from a non-equilibrium heat treatment. It is possible to austenitize a steel at a temperature for which the phase diagram would indicate a single phase austenite region at equilibrium conditions, but because the system does not attain equilibrium or near equilibrium conditions (e.g., time at temperature is limited to a practical time from an engineering standpoint), not all carbides are taken into solution in the austenite at the austenitizing temperature. In such case, the steel when cooled to room temperature would consist of martensite, retained austenite, undissolved carbides and other constituents as described above.

Therefore, it is possible to attain the minimum desired amount of retained austenite of at least 40 percent by volume even though all of the carbides and alloying elements are not in solution. The important feature is that the matrix itself resulting from the non-equilibrium heat treatment comprises at least approximately 40 percent by volume of retained austenite.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth is to be interpreted as illustrative, and not in a limiting sense.

Having thus described our invention, we claim:

1. A wear resistant comminuting member comprising a generally martensitic/austenitic steel which contains at least about 40 percent by volume retained austenite, a portion of which is work transformable to martensite.

2. The wear resistant comminuting member as in claim 1, wherein said retained austenite being determined by a modified ASTM Method E975 using three austenite peaks and three ferrite/martensite peaks.

3. The wear resistant comminuting member as in claim 1, wherein said steel contains from 50 to 100 percent by volume retained austenite.

4. The wear resistant comminuting member as in claim 1, wherein said martensitic/austenitic steel, which contains at least about 40 percent by volume retained austenite, comprises the outermost volume of said comminuting member representing at least 25 percent of the total volume of said comminuting member.

5. The wear resistant comminuting member as in claim 1, wherein said comminuting member is selected from the group consisting of spheres, rods, cylinders, cones, cylpebs, bullets, slugs, liner plates, grinding wear surfaces, and crusher wear surfaces.

6. The wear resistant comminuting member as in claim 1, wherein said steel includes carbon, iron and an alloy selected from the group consisting of chromium, manganese, nickel, silicon, molybdenum, vanadium, copper, and combinations thereof.

7. The wear resistant comminuting member as in claim 6, wherein said steel includes carbon, iron and an alloy selected from the group consisting of chromium, manganese, nickel, silicon, molybdenum, and combinations thereof.

8. The wear resistant comminuting member as in claim 7, wherein said steel includes carbon, iron and an alloy selected from the group consisting of chromium, manganese, and combinations thereof.

9. The wear resistant comminuting member as in claim 1, wherein said steel is characterized by a martensite start temperature (Ms) between about 0 and 300 degrees Fahrenheit (−18° C. to 149° C.) as determined by the following Nehrenberg relationship:

Ms (in ° F.)=930−540*(%carbon)−60*(%manganese)−40*(%chromium)−30*(%nickel)−20*(%silicon)- 20*(%molybdenum); or Ms (in ° C.)=[898−540*(%carbon)−60*(%manganese)−40*(%chromium)−30*(%nickel)−20*(%silicon)−20*(%molybdenum)]÷1.8.

10. The wear resistant comminuting member as in claim 8, wherein said martensite start temperature is between about 30 and 225 degrees Fahrenheit (−1° C. to 107° C.).

11. The wear resistant comminuting member as in claim 10, wherein said martensite start temperature is between about 50 to 150 degrees Fahrenheit (10° C. to 66° C.).

12. The wear resistant comminuting member as in claim 1, wherein said steel includes about 0.4 to 2.0 percent carbon by weight and the balance is primarily iron.

13. The wear resistant comminuting member as in claim 12, wherein said steel includes an alloy selected from the group consisting of 0 to 8 percent Cr by weight, 0 to 6 percent Mn by weight, 0 to 2 percent Ni by weight, 0 to 2 percent Si by weight, 0 to 2 percent Mo by weight, 0 to 4 percent Cu by weight, 0 to 1 percent V by weight, and combinations thereof.

14. The wear resistant comminuting member as in claim 13, wherein said steel includes an alloy selected from the group consisting of 0 to 8 percent Cr by weight, 0 to 6 percent Mn by weight, 0 to 2 percent Ni by weight, 0 to 2 percent Si by weight, 0 to 2 percent Mo by weight, and combinations thereof.

15. The wear resistant comminuting member as in claim 14, wherein said steel includes an alloy selected from the group consisting of 0 to 8 percent Cr by weight, 0 to 6 percent Mn by weight, and combinations thereof.

16. A wear resistant comminuting member comprising a generally martensitic/austenitic steel which contains retained austenite, a portion of which is work transformable to martensite, and wherein said steel is characterized by a martensite start temperature between about 0 and 300 degrees Fahrenheit (−18° C. to 149° C.) as determined by the following Nehrenberg relationship:

Ms (in ° F.)=930−540*(%carbon)−60*(%manganese)−40*(%chromium)−30*(%nickel)−20* (%silicon)−20* (%molybdenum); or Ms (in ° C.)=[898−540*(%carbon)−60*(%manganese)−40*(%chromium)−30*(%nickel)−20*(%silicon)−20*(%molybdenum)]÷1.8.

* * * * *